US011528782B2

(12) United States Patent
Kwack et al.

(10) Patent No.: US 11,528,782 B2
(45) Date of Patent: Dec. 13, 2022

(54) SINGLE PULSE PRE-TEST METHOD FOR IMPROVING VESSEL DETECTION ACCURACY

(71) Applicant: LG Electronics Inc., Seoul (KR)

(72) Inventors: Younghwan Kwack, Seoul (KR); Seongho Son, Seoul (KR); Jaekyung Yang, Seoul (KR); Yongsoo Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 424 days.

(21) Appl. No.: 16/678,781

(22) Filed: Nov. 8, 2019

(65) Prior Publication Data

US 2020/0154529 A1 May 14, 2020

(30) Foreign Application Priority Data

Nov. 8, 2018 (KR) ..... 10-2018-0136321

(51) Int. Cl.
*H05B 6/06* (2006.01)

(52) U.S. Cl.
CPC ..... *H05B 6/062* (2013.01); *H05B 2213/05* (2013.01); *H05B 2213/07* (2013.01)

(58) Field of Classification Search
CPC . H05B 2213/07; H05B 6/062; H05B 2213/05
See application file for complete search history.

(56) References Cited

U.S. PATENT DOCUMENTS 5,648,008 A * 7/1997 Barritt ..... H05B 6/062 219/661
2005/0072167 A1* 4/2005 Oh ..... F25C 1/04 62/137
2007/0085517 A1* 4/2007 Ribarich ..... H02M 1/4225 323/235

(Continued)

FOREIGN PATENT DOCUMENTS

EP 2999302 3/2016
JP 2005142097 6/2005

(Continued)

OTHER PUBLICATIONS

Extended European Search Report in European Application No. 19195791.9, dated Apr. 2, 2020, 6 pages.

*Primary Examiner* — Dana Ross
*Assistant Examiner* — Kuangyue Chen
(74) *Attorney, Agent, or Firm* — Fish & Richardson P.C.

(57) ABSTRACT

Described is a method for controlling an induction heating device having one or more working coils and a controller configured to perform pre-testing based on a single pulse. The method includes: selecting a working coil to be tested, performing a detection operation to detect a vessel disposed on the working coil and generate a first output pulse; comparing at least one of: a count of the first output pulse to a predetermined reference count range, or an on-duty time of the first output pulse to a predetermined reference time range; and adjusting, by the controller, a duration of an on-state of the single pulse based on (i) a result of the (Continued)

comparison of the count of the first output pulse to the predetermined reference count range or (ii) a result of the comparison of the on-duty time of the first output pulse to the predetermined reference time range.

20 Claims, 15 Drawing Sheets

(56) References Cited

U.S. PATENT DOCUMENTS

| | | | | |
|---|---|---|---|---|
| 2007/0164017 | A1* | 7/2007 | Gouardo | H05B 6/065 219/626 |
| 2008/0035609 | A1* | 2/2008 | Kashkoush | H01L 21/31111 216/84 |
| 2018/0063891 | A1* | 3/2018 | Imai | H02M 5/4585 |

FOREIGN PATENT DOCUMENTS

| | | |
|---|---|---|
| JP | 2016042431 | 3/2016 |
| KR | 20150074065 | 7/2015 |
| WO | WO2013064331 | 5/2013 |

* cited by examiner

SINGLE PULSE PRE-TEST METHOD FOR IMPROVING VESSEL DETECTION ACCURACY

CROSS-REFERENCE TO RELATED APPLICATION

The present disclosure claims priority to and the benefit of Korean Patent Application No. 10-2018-0136321, filed on Nov. 8, 2018, the disclosure of which is incorporated herein by reference in its entirety.

FIELD

The present disclosure relates to a method for pre-testing of a single pulse for improving accuracy in vessel detection.

BACKGROUND

Various types of cooking utensils may be used to heat food in homes and restaurants. For example, gas ranges may use gas as fuel. In some cases, cooking devices may use electricity instead of gas to heat an object such as a cooking vessel or a pot, for example.

A method of heating an object via electricity may be classified into a resistive heating method and an induction heating method. In the electrical resistive method, heat may be generated based on current flowing through a metal resistance wire or a non-metallic heating element, such as silicon carbide, and may be transmitted to the object through radiation or conduction, to heat the object. In the induction heating method, eddy current may be generated in the object made of metal based on a magnetic field that is generated around the coil when a high-frequency power of a predetermined magnitude is applied to the coil to heat the object.

In some cases, an induction heating device may have a function for detecting whether the object is present on a working coil, namely, a function for detecting a vessel.

For example, FIG. 1 shows an induction heating device that has a function for detecting a vessel in the related art. The induction heating device in the related art will be described with reference to FIG. 1.

FIG. 1 is a schematic view of the induction heating device in the related art.

Referring to FIG. 1, the induction heating device includes a power supply 61, a switching unit 62, a working coil 63, a zero point detector 64, a controller 65, and a current converter 66 in the related art.

Specifically, the power supply 61 may provide the switching unit 62 with direct current (DC), and the switching unit 62 may provide the working coil 63 with resonant current through switching. The zero point detector 64 may detect a zero point of a commercial power supply and transmit a zero-point signal to the controller 65. The current converter 66 may measure the resonance current flowing through the working coil 63 to transmit information on a voltage fluctuation waveform to the controller 65. The controller 65 may control an operation of the switching unit 62 based on the information on the zero-point signal and the voltage fluctuation waveform received from the zero point detector 64 and the current converter 66, respectively.

In this example, the controller 65 may calculate a voltage value based on the information on the zero-point signal and the voltage fluctuation waveform received from the zero point detector 64 and the current converter 66, respectively. Then, when the voltage value calculated by the controller 65 deviates from a predetermined fluctuation range, the controller 65 may determine that the vessel 70 is not provided on the working coil 63.

However, the induction heating device determines whether the vessel 70 is present on the working coil 63 only at a zero time point (that is, a time point at which the input voltage becomes zero voltage) of input voltage (that is, the commercial power supply) in the related art. In such cases, the induction heating device may have a degraded accuracy in detection of the vessel and have a high power consumption in the related art.

In some cases, when the input voltage output from the power supply 61 is changed, an accurate detection of the vessel would be difficult in the induction heating device in the related art. For example, when an adjacent working coil is operated, an input voltage may be distributed to the adjacent working coil, and thus the input voltage applied to a working coil to be tested may be lowered. In this case, the accuracy in the vessel detection may be deteriorated.

SUMMARY

The present disclosure provides a method for pre-testing of a single pulse of an induction heating device, where the method may improve accuracy in operation of detecting a vessel.

The present disclosure also provides a method for pre-testing of a single pulse of the induction heating device that is operated at lower power consumption and has a quick response characteristic.

The objects of the present disclosure are not limited to the above-mentioned objects, and other objects and advantages of the present disclosure which are not mentioned can be understood by the following description and more clearly understood by the implementations of the present disclosure. It will also be readily apparent that the objects and advantages of the present disclosure may be realized by means defined in claims and a combination thereof.

According to one aspect of the subject matter described in this application, a method controls an induction heating device having one or more working coils and a controller configured to perform pre-testing based on a single pulse. The method includes: selecting a working coil to be tested, performing a detection operation to detect a vessel disposed on the working coil and generate a first output pulse; comparing at least one of: a count of the first output pulse to a predetermined reference count range, or an on-duty time of the first output pulse to a predetermined reference time range; and adjusting, by the controller, a duration of an on-state of the single pulse based on (i) a result of the comparison of the count of the first output pulse to the predetermined reference count range or (ii) a result of the comparison of the on-duty time of the first output pulse to the predetermined reference time range.

Implementations according to this aspect may include one or more of the following features. For example, the count of the first output pulse may include a number of instances at which the first output pulse is changed from an off-state to an on-state. In these implementations, adjusting the duration of the on-state of the single pulse may include: based on the count of the first output pulse being greater than an upper limit value of the predetermined reference count range, decreasing the duration of the on-state of the single pulse; based on the count of the first output pulse being less than a lower limit value of the predetermined reference count range, increasing the duration of the on-state of the single pulse; and based on the count of the first output pulse being within the predetermined reference count range, maintaining the duration of the on-state of the single pulse.

In some implementations, the on-duty time of the first output pulse may include an accumulated time of on-state durations of the first output pulse. In these implementations, adjusting the duration of the on-state of the single pulse may include: based on the on-duty time being greater than an upper limit value of the predetermined reference time range, decreasing the duration of the on-state of the single pulse; based on the on-duty time being less than a lower limit value of the predetermined reference time range, increasing the duration of the on-state of the single pulse; and based on the on-duty time being within the predetermined reference time range, maintaining the duration of the on-state of the single pulse.

In some implementations, the method may further include: performing the detection operation to generate a second output pulse based on the duration of the on-state of the single pulse being changed; comparing at least one of (i) a count of the second output pulse to the predetermined reference count range or (ii) an on-duty time of the second output pulse to the predetermined reference time range; and adjusting the changed duration of the on-state of the single pulse based on (i) a result of the comparison of the count of the second output pulse to the predetermined reference count range or (ii) a result of the comparison of the on-duty time of the second output pulse to the predetermined reference time range.

In some implementations, performing the detection operation may include: repeating the detection operation for a plurality of times to generate a plurality of first output pulses. In some examples, the count may include an average value of counts of the plurality of first output pulses, and the on-duty time may include an average value of on-duty durations of the plurality of first output pulses.

In some implementations, the method may further include charging the working coil with energy based on the single pulse, where an amount of energy charged in the working coil during the detection operation may vary based on the duration of the on-state of the single pulse. In some examples, the amount of energy charged in the working coil during the detection operation may increase based on an increase of the duration of the on-state of the single pulse, and the amount of energy charged in the working coil during the detection operation may decrease based on a decrease of the duration of the on-state of the single pulse.

In some implementations, performing the detection operation may include: controlling an inverter of the induction heating device to charge the working coil with energy; measuring, by a sensor of the induction heating device, a current in the working coil; converting a first current value of the current measured by the sensor into a first voltage value; comparing, by a shutdown comparator of the induction heating device, the first voltage value to a predetermined reference resonance value; and controlling a switch driver of the induction heating device to cause resonance of the current in the working coil based on the first voltage value being greater than the predetermined reference resonance value. Performing the detection operation may further include: measuring, by the sensor, a resonant current in the working coil based on the resonance of the current in the working coil; converting a second current value of the resonant current in the working coil into a second voltage value; and comparing the second voltage value to a predetermined count reference value to generate the first output pulse.

In some examples, the inverter may include a first switching element and a second switching element that are configured to be turned on and turned off based on a switching signal received from the switch driver, where controlling the inverter may include controlling one or both of the first switching element and the second switching element. In some examples, charging the working coil with energy may include turning on the first switching element and turning off the second switching element. In some examples, controlling the switch driver to cause the resonance of the current in the working coil may include turning off the first switching element and turning on the second switching element. In some examples, controlling the switch driver to cause the resonance of the current in the working coil may include maintaining an output signal of the shutdown comparator in an activated state for a predetermined period of time.

In some examples, comparing the second voltage value to the predetermined count reference value to generate the first output pulse may include: generating the first output pulse in an on-state based on the second voltage value being greater than the predetermined reference count value; and generating the first output pulse in an off-state based on the second voltage value being less than the predetermined reference count value.

In some implementations, selecting the working coil may include selecting one working coil that does not seat an object among the one or more working coils. In some implementations, the method may further include: counting a number of instances at which the first output pulse is changed from an off-state to an on-state; and based on counting the number of instances at which the first output pulse is changed from the off-state to the on-state, determining the count of the first output pulse.

In some implementations, the method may further include: based on an amplitude of the first output pulse, determining whether the first output pulse corresponds to an on-state or an off-state, wherein the first output pulse may include a plurality of on-state pulses and a plurality of off-state pulses; accumulating durations of the plurality of on-state pulses of the first output pulse; and determining the on-duty time of the first output pulse based on the accumulated durations of the plurality of on-state pulses of the first output pulse.

In some implementations, the method includes comparing the count of the first output pulse to the predetermined reference count range, where adjusting the duration of the on-state of the single pulse may be based on the result of the comparison of the count of the first output pulse to the predetermined reference count range.

In some implementations, the method includes comparing the on-duty time of the first output pulse to the predetermined reference time range, where adjusting the duration of the on-state of the single pulse may be based on the result of the comparison of the on-duty time of the first output pulse to the predetermined reference time range.

In some examples, repeating the detection operation for the plurality of times may include generating one first output pulse in each of the plurality of times of the detection operation.

In some implementations, the method for pre-testing of a single pulse of the induction heating device includes adjusting duration of the on-state of the single pulse based on count or an on-duty time of an output pulse, thereby improving accuracy in the operation of the vessel detection.

In some implementations, the method for pre-testing of a single pulse of the induction heating device may be performed in a particular section based on a zero crossing time point, thereby reducing power consumption and improving response characteristic of the induction heating device.

In some implementations, it may be possible to improve the accuracy in the operation of detecting the vessel through the method for pre-testing the single pulse, thereby improving reliability of the operation of detecting the vessel.

In some implementations, the power consumption of the induction heating device may be reduced and the response characteristic of the induction heating device may be improved through the method for pre-testing the single pulse of the induction heating device, thereby preventing waste of the power consumption of the induction heating device and improving user satisfaction.

A specific effect of the present disclosure, in addition to the above-mentioned effect, will be described together while describing a specific matter for implementing the present disclosure.

DETAILED DESCRIPTION

The above mentioned objects, features, and advantages of the present disclosure will be described in detail with reference to the accompanying drawings, so that those skilled in the art to which the present disclosure pertains may easily implement the technical idea of the present disclosure.

Figure 1:
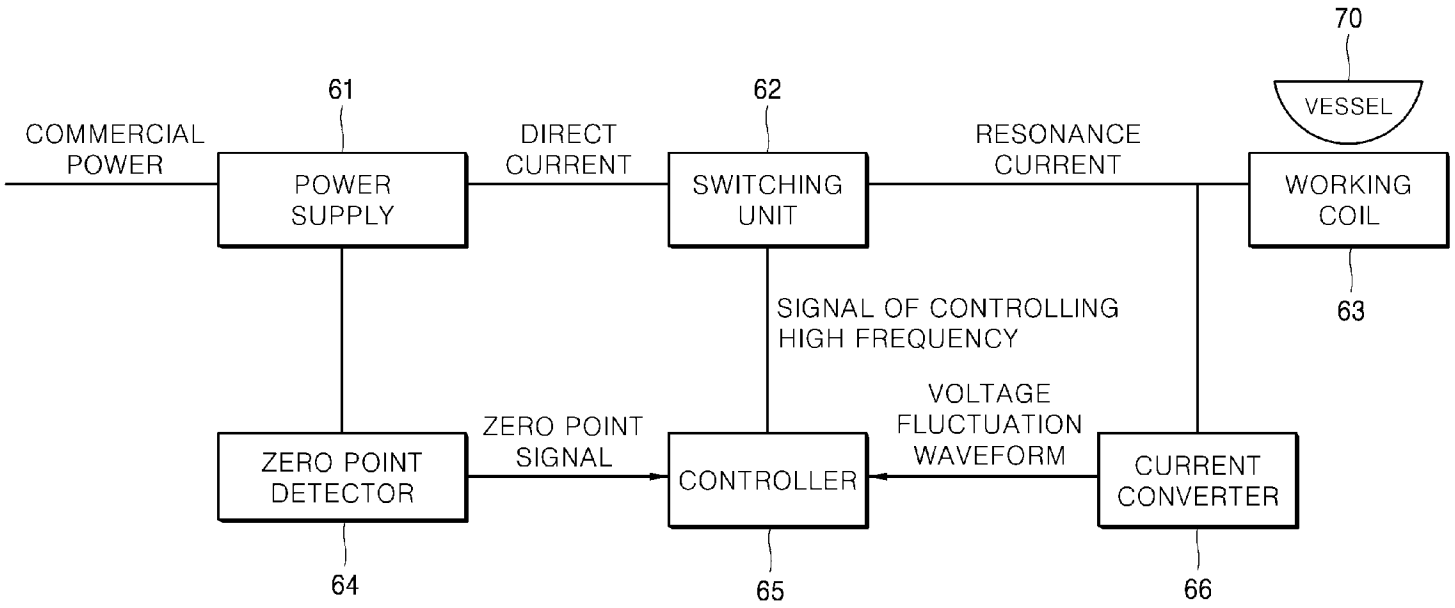
FIG. 1 RELATED ART
FIG. 1 is a schematic view of an example of an induction heating device in the related art.
Figure 2:
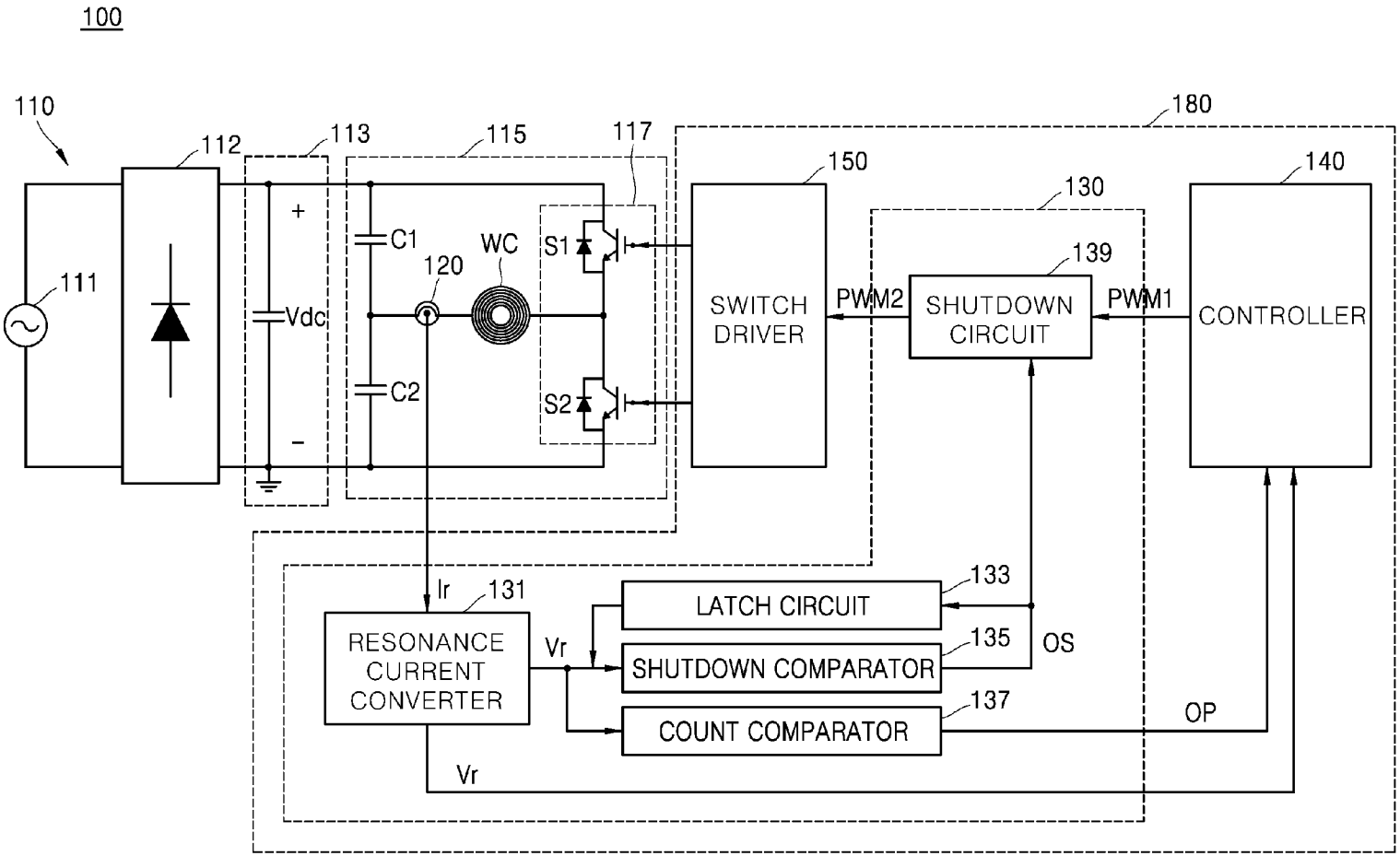
FIG. 2 is a schematic view of an example of an induction heating device according to an implementation of the present disclosure.
Figure 3:
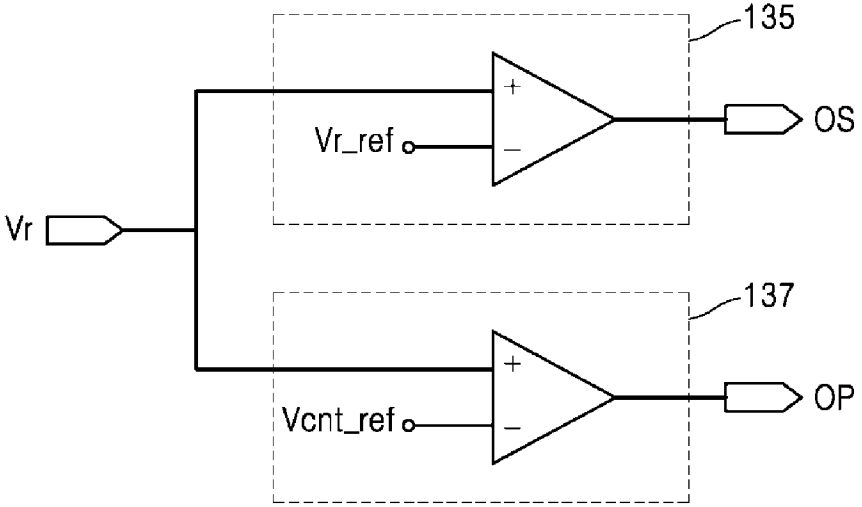
FIG. 3 is a schematic view of an example shutdown comparator and an example count comparator of FIG. 2.

FIG. 2 is a schematic view of an example induction heating device according to an implementation of the present disclosure. FIG. 3 is a schematic view of an example shutdown comparator and an example count comparator of FIG. 2.

Referring to FIGS. 2 and 3, an induction heating device 100 includes an induction heating circuit 110 that drives a working coil WC, a sensor that measures current flowing through the working coil WC, and a controller 180 that controls an induction heating circuit 110 based on the current measured by the sensor 120.

An induction heating circuit 110 may include a power supply 111, a rectifier 112, a direct current (DC) link capacitor 113, and an induction heater 115.

The power supply 111 may output alternating current (AC) power.

Specifically, the power supply 111 may output the AC power and may provide the rectifier 112 with the AC power and may be, for example, commercial power supply.

The rectifier 112 may convert the AC power received from the power supply 111 into a DC power and supply the DC power to an inverter 117.

Specifically, the rectifier 112 may rectify the AC power received from the power supply 111 and may convert the AC power into the DC power. The rectifier 112 may also provide the DC link capacitor 113 with the DC power converted from the rectifier 112.

For example, the rectifier 112 may include, but is not limited to, a bridge circuit that has one or more diodes.

The DC link capacitor 113 may receive the DC power from the rectifier 112 and may reduce ripple of the DC power received from the rectifier 112. The DC link capacitor 113 may also include a smoothing capacitor, for example.

Specifically, the DC link capacitor 113 may receive the DC voltage from the rectifier 112 so that DC voltage Vdc (hereinafter; referred to as "input voltage") may be applied to both ends of the DC link capacitor 113.

As described above, a DC power (or DC voltage) that is rectified by the rectifier 112 and that has reduced ripple by the DC link capacitor 113 may be supplied to the inverter 117.

The induction heater 115 may drive a working coil WC.

Specifically, the induction heater 115 may include the inverter 117 and a resonance capacitor (that is, C1 and C2).

In some implementations, the inverter 117 may include two switching elements S1 and S2. The first and second switching elements S1 and S2 are alternately turned-on and turned-off based on a switching signal received from a switch driver 150, so that the DC power is converted into a high frequency of AC (that is, resonance current). Thus, the converted high-frequency of AC may be provided to the working coil WC.

For example, the first and second switching elements S1 and S2 may include, but are not limited to, for example, an insulated gate bipolar transistor (IGBT).

The resonance capacitor may include first and second resonance capacitors C1 and C2 connected in parallel with the first and second switching elements S1 and S2, respectively.

Specifically, when the voltage is applied to the resonance capacitors C1 and C2 based on the switching of the inverter 117, the resonance capacitors C1 and C2 start to resonate. Further, when the resonance capacitors C1 and C2 resonate, the magnitude of the current flowing through the working coil WC connected to the resonance capacitors C1 and C2 is increased.

Through such a process, eddy current is induced into an object (for example, a cooking vessel) located on the working coil WC connected to the resonance capacitors C1 and C2.

For example, the working coil WC may include at least one of, for example, a single coil structure having a single coil, a dual coil structure having an inner coil and an outer coil, and a multi-coil structure having a plurality of coils.

In some examples, the sensor 120 may measure a value Ir of the current flowing through the working coil WC.

Specifically, the sensor 120 may be connected to the working coil WC in series, and may measure the value Ir of the current flowing through the working coil WC.

For example, the sensor 120 may include, for example, a current measuring sensor that directly measures the current value, and may include a current transformer.

When the sensor 120 includes the current measuring sensor, the sensor 120 may directly measure the value Ir of the current flowing through the working coil WC and may provide a resonance current converter 131 described below with the information on the measured current value Ir. In some examples, when the sensor 120 includes the current transformer, the sensor 120 converts a magnitude of the current flowing through the working coil WC by the current transformer to provide the resonance current converter 131 with the current in which the magnitude of which is changed.

However, for convenience of explanation, in the implementation of the present disclosure, the sensor 120 includes the current measuring sensor that directly measures the value of the current Ir flowing through the working coil WC.

In some examples, the sensor 120 may be a component included in the induction heating circuit 110 or the controller 180, which is not an independent component depending on the situation. However, for convenience of explanation, in the implementation of the present disclosure, the sensor 120 is an independent component.

The controller 180 may include the vessel detector 130, the controller 140, and the switch driver 150.

The vessel detector 130 may determine a state of a second pulse signal PWM2 (particularly, PWM2-HIN of FIG. 4) provided to the switch driver 150 based on the value of the current measured by the sensor 120.

Further, the vessel detector 130 may include a resonant current converter 131, a latch circuit 133, a shutdown comparator 135, a count comparator 137, and a shutdown circuit 139.

Specifically, the resonance current converter 131 may convert the value Ir of the current measured by the sensor 120 into a voltage value Vr. The resonance current converter 131 may also transmit the information on the converted voltage value Vr to the shutdown comparator 135, the count comparator 137, and the controller 140, respectively.

That is, the resonance current converter 131 may convert the value Ir of the current received from the sensor 120 into the voltage value Vr and may transmit the information on the converted voltage value Vr to the shutdown comparator 135, the count comparator 137 and the controller 140, respectively.

The voltage value, provided by the resonance current converter 131, to the shutdown comparator 135 is different from the voltage value, provided by the resonance current converter 131, to the count comparator 137, and the details thereof will be described below.

In some implementations, the resonance current converter 131 is not necessary and may be omitted. In this case, the information on the value Ir of the current measured by the sensor 10 may be transmitted to the shutdown comparator 135, the count comparator 137, and the controller 140.

However, for convenience of explanation, in the implementation of the present disclosure, the induction heating device 100 includes the resonance current converter 131.

The shutdown comparator 135 may compare whether the voltage value Vr received from the resonance current converter 131 is greater than a predetermined reference value of resonance Vr_ref.

Specifically, the shutdown comparator 135 may compare the voltage value Vr received from the resonance current converter 131 with a predetermined reference value of resonance Vr_ref.

In some examples, the shutdown comparator 135 may activate an output signal OS when the voltage value Vr received from the resonance current converter 131 is greater than the predetermined reference value of resonance Vr_ref. The shutdown comparator 135 may deactivate the output signal OS when the voltage value Vr received from the resonance current converter 131 is less than a predetermined reference value of resonance Vr_ref.

In some examples, activating the output signal OS may include outputting the output signal OS at a high level (for example, '1'). In the same or other examples, deactivating the output signal OS may include outputting the output signal OS at a low level (for example, '0').

The output signal OS of this shutdown comparator 135 may be provided to the shutdown circuit 139.

A state of the second pulse signal PWM2 (particularly, PWM2-HIN of FIG. 4) output from the shutdown circuit 139 is determined depending on the activation or the deactivation of the output signal OS, and details thereof will be described below.

A latch circuit 133 may maintain the activation state of the output signal OS output from the shutdown comparator 135 for a predetermined period of time.

Specifically, when the output signal OS of the shutdown comparator 135 is activated, the latch circuit 133 may maintain an activation state of the output signal OS output from the shutdown comparator 135 for a predetermined period of time.

The count comparator 137 may compare whether the voltage value Vr received from the resonance current converter 131 is greater than a predetermined reference value of count Vcnt_ref and may output the output pulse OP based on a result of comparison.

Specifically, when the voltage value Vr received from the resonance current converter 131 is greater than a predetermined reference value of count Vcnt_ref, the count comparator 137 outputs the output pulse OP in an on-state.

When the voltage value Vr received from the resonance current converter 131 is less than the predetermined reference value of count Vcnt_ref, the count comparator 137 outputs the output pulse OP in an off-state.

The output pulse OP in the on-state has a logical value of '1' and the output pulse OP in the off-state has a logical value of '0'.

Accordingly, the output pulse OP output from the count comparator 137 may have a form of a square wave in which the on-state and the off-state are repeated.

For example, the output pulse OP output from the count comparator 137 may be provided to the controller 140.

Accordingly, the controller 140 may determine whether the object is present on the working coil WC based on count and on-duty time of the output pulse OP received from the count comparator 137.

The shutdown circuit 139 may provide the switch driver 150 with the second pulse signal PWM2 for detecting the vessel.

Specifically, the shutdown circuit 139 may provide the switch driver 150 with the second pulse signal PWM2, and the switch driver 150 may turn on and turn off the first and second switching elements S1 and S2 in the inverter 117 in a complementary manner based on the second pulse signal PWM2. For example, the switch driver 150 may turn on and turn off one or both of the first and second switching elements S1 and S2 simultaneously. In another, the switch driver 150 may turn on and turn off one or both of the first and second switching elements S1 and S2 sequentially.

The second pulse signal PWM2 may include a signal PWM2-HIN (see FIG. 4) to control a turn-on or a turn-off of the first switching element S1 and a signal PWM2-LIN (see FIG. 4) to control a turn-on or a turn-off of the second switching element S2.

For example, the state of the second pulse signal PWM2 (particularly, PWM2-HIN of FIG. 4) of the shutdown circuit 139 may be determined depending on the activation or the deactivation of the output signal OS received from the shutdown comparator 135.

Specifically, when the output signal OS is activated, the shutdown circuit 139 may provide the switch driver 150 with the second pulse signal in the off-state (that is, PWM2-HIN of a low level (logical value of '0')).

That is, the shutdown circuit 139 provides the switch driver 150 with the second pulse signal (that is, PWM2-HIN of FIG. 4) in the off-state so that the first switching element S1 is turned off.

When the output signal OS is deactivated, the shutdown circuit 139 provides the switch driver 150 with the second pulse signal of the on-state (that is, PWM2-HIN of the high level (a logical value of '1')).

That is, the shutdown circuit 139 provides the switch driver 150 with the second pulse signal in the on-state (that is, PWM2-HIN of FIG. 4) so that the first switching element S1 is turned on.

The controller 140 controls the shutdown circuit 139 and the switch driver 150.

Specifically, the controller 140 may control the switch driver 150 by providing the shutdown circuit 139 with the first pulse signal PWM1.

Further, the controller 140 may receive the output pulse OP from the count comparator 137.

Specifically, the controller 140 may determine whether the object is present on the working coil WC based on the count or the on-duty time of the output pulse OP received from the count comparator 137.

When it is determined that the object is present on the working coil WC, the controller 140 activates (that is, drives) the working coil WC by controlling the switch driver 150.

The count refers to a number of instances at which the state of the output pulse OP is changed from the off-state to the on-state. The on-duty time may refer to an accumulated time of one or more durations while the output pulse OP is in the on-state during a period of time (that is, D3 of FIG. 4). During the period of time D3, free resonance of the resonance current may occur in a section where current flows including the working coil WC and the second switching element S2.

In some examples, the controller 140 may count a number of instances at which the output pulse OP is changed from an off-state (e.g., a low amplitude) to an on-state (e.g., a high amplitude), and determine the count of the first output pulse based on the number of instances at which the output pulse OP is changed from the off-state to the on-state.

In some implementations, the controller 140 may enable displaying the detection of the object through a display or an input interface or may notify the user of the detection of the object through notification sound.

Figure 4:
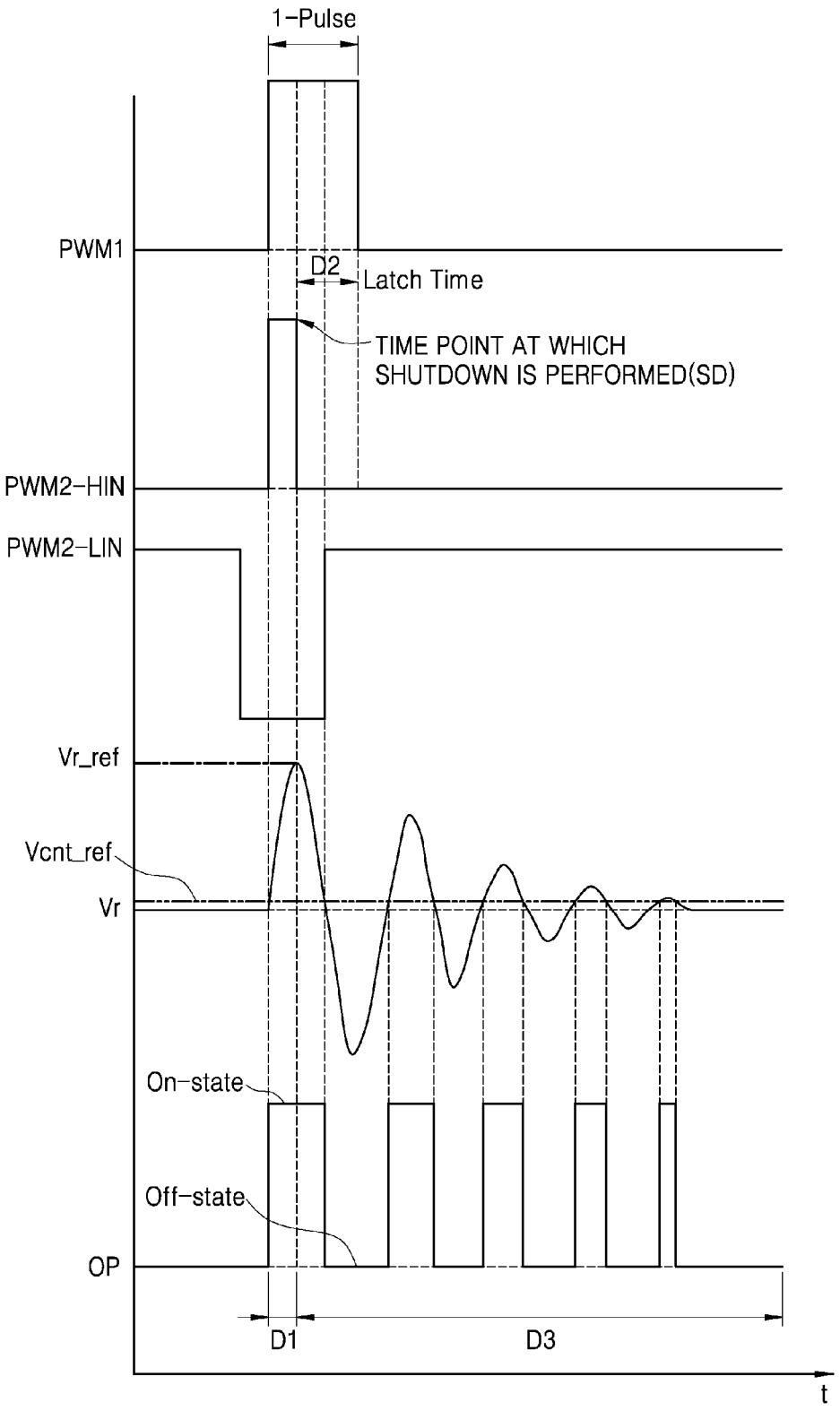
FIG. 4 is a graph of an example method for detecting a vessel, by the induction heating device of FIG. 2.

For example, the controller 140 may include, but is not limited to, a micro controller that outputs a first pulse signal PWM1 (i.e., a single pulse (1-pulse) of FIG. 4) of a predetermined magnitude.

The controller 140 may also sense or receive information (e.g., receive from the sensor 120) on the voltage (for example, input voltage) applied to the inverter 117. The length of a single pulse (that is, the duration of the on-state of a single pulse) is adjusted based on an amount of fluctuation, and the like of the received voltage, and details thereof will be described below.

The switch driver 150 may be driven based on drive voltage, of the driver, received from an external power supply, and may be connected to the inverter 117 to control the switching of the inverter 117.

Further, the switch driver 150 may control the inverter 117 based on the second pulse signal PWM2 received from the shutdown circuit 139. That is, the switch driver 150 may turn on or off the first and second switching elements S1 and S2 the inverter 117 includes based on the second pulse signal PWM2.

For example, the switch driver 150 includes first and second sub-switch drivers to turn on or off the first and second switching elements S1 and S2, respectively, and details thereof will be described below.

Hereinafter, a method for detecting a vessel, by the induction heating device, of FIG. 2 will be described with reference to FIGS. 4 to 6.

FIG. 4 is a graph of an example method for detecting a vessel, by the induction heating device of FIG. 2. FIGS. 5 and 6 show example methods for detecting a vessel, by the induction heating device of FIG. 2.

Figure 5:
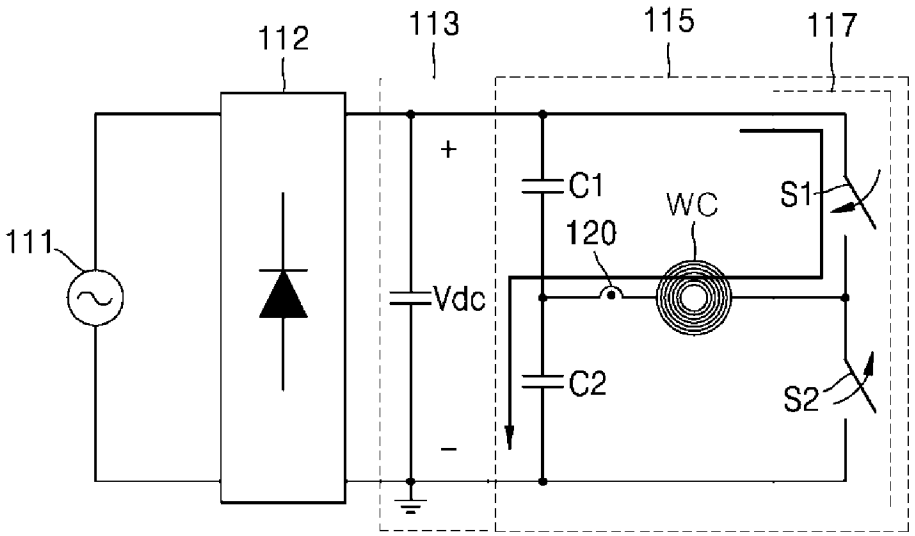
FIGS. 5 and 6 show an example method for detecting a vessel, by the induction heating device of FIG. 2.
Figure 6:
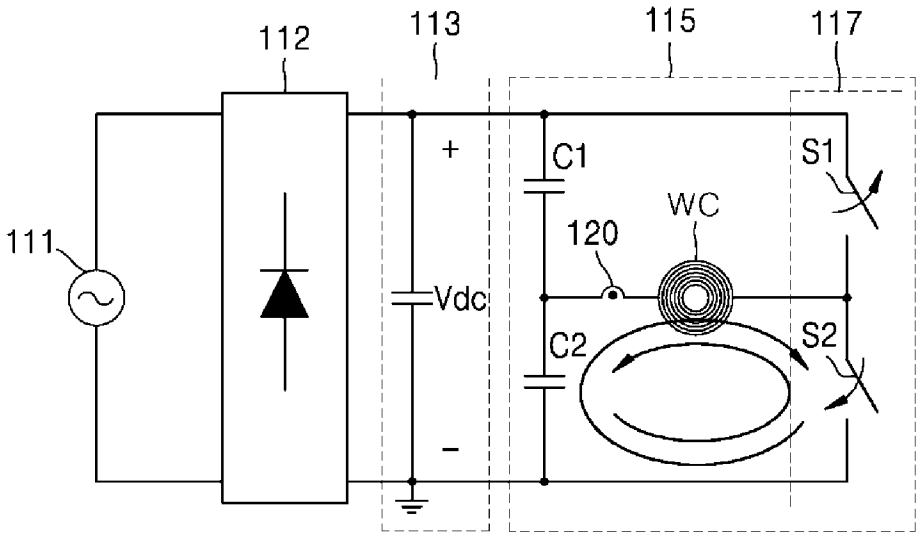

For example, the above-described controller 180 is omitted from FIGS. 5 and 6 for convenience of explanation.

Referring to FIGS. 2 and 4 to 6, the controller 140 provides a shutdown circuit 139 with a first pulse signal PWM1. At this time, the controller 140 may provide the shutdown circuit 139 with a single pulse (1-pulse).

The shutdown circuit 139 transmits a second pulse signal (PWM2) to the switch driver 150 based on the single pulse (1-Pulse) received from the controller 140.

As shown in FIGS. 4 and 5, a switch driver 150 turns on the first switching element S1 and turns off the second switching element S2 while the second pulse signal (PWM2; that is, PWM2-HIN) is input, from the shutdown circuit 139.

In this process, the DC link capacitor 113 and the working coil WC to which the input voltage Vdc is applied form a section in which the current flows, and energy of the input voltage Vdc is transmitted to the working coil WC so that current passing through the working coil WC flows through the section in which the current flows.

The sensor 120 measures the value Ir of the current passing through the working coil WC and transmits the information on the measured current value Ir to the resonance current converter 131. The resonance current converter 131 converts the measured current value Ir (current value measured before the resonance current freely resonates) into a voltage value Vr (that is, a first voltage value), and provides a shutdown comparator 135 with the information on the converted voltage value Vr.

The shutdown comparator 135 compares the voltage value Vr received from the resonance current converter 131 with a predetermined reference value of resonance Vr_ref.

When the supplied voltage value Vr is greater than the predetermined reference value of resonance Vr_ref, the shutdown comparator 135 provides the shutdown circuit 139 with the activated output signal OS. A time point at which the shutdown circuit 139 receives the activated output signal OS from the shutdown comparator 135 corresponds to a time point at which the shutdown is performed SD.

That is, the working coil WC is charged with energy by the input voltage Vdc for a period of time of D1. Then, when the working coil WC is sufficiently charged with the energy and the working coil WC has an energy level exceeding a predetermined threshold value (that is, a predetermined reference value of resonance Vr_ref), the shutdown circuit 139 provides the switch driver 150 with the second pulse signal (PWM2; that is, PWM2-HIN) in the off-state so that the working coil WC is not charged with the energy.

Accordingly, the shutdown circuit 139 may control the switch driver 150 to store a predetermined magnitude of energy in the working coil WC. Further, as the free resonance of the resonance current constantly occurs in the section in which the current flows including the working coil WC and the second switching element S2, thereby improving accuracy and reliability in the function for detecting the vessel.

In addition, after a time point at which the shutdown is performed SD, the latch circuit 133 maintains the activated state of the output signal OS of the shutdown comparator 135 for a predetermined period of time D2 (i.e., a latch time) to prevent the output signal OS activated during the input, of the first pulse signal PWM1, to the shutdown circuit 139 from being deactivated.

Accordingly, when the output signal OS of the shutdown comparator 135 is activated once, the output signal OS of the shutdown comparator 135 may maintain an activated state for a predetermined period of time. Therefore, the shutdown circuit 139 may maintain the second pulse signal PWM2-HIN associated with the first switching element S1 in an off-state while the output signal OS is activated.

For example, when the output signal OS is activated and the second pulse signal PWM2 (that is, PWM2-HIN) in an off-state is provided from the shutdown circuit 139 to the switch driver 150, the first switching element S1 is turned off so that the working coil WC may not be charged with the voltage (that is, energy). However, even if the first switching element S1 is turned off at the time point when the shutdown is performed SD, the voltage applied to the working coil WC may be slightly increased beyond the predetermined reference value of resonance Vr_ref after the time point at which the shutdown is performed SD and then decreases again.

At this time, when the voltage provided to the working coil WC falls to or below a predetermined reference value of resonance Vr_ref, the shutdown comparator 135 may receive the voltage value Vr_ref less than the predetermined reference value of resonance Vr_ref from the resonance current converter 131, and may deactivate the output signal OS. In this case, the first switching element S1 may be turned on again, while the shutdown circuit 139 provides the switch driver 150 with the second pulse signal PWM2 (that is, PWM2-HIN) in the on-state. As a result, the working coil WC that has already charged with the energy may be further charged with unnecessary energy.

In some implementations, in order to mitigate the behavior described above, the latch circuit 133 may maintain the activation state of the output signal OS of the shutdown comparator 135 for a predetermined period of time D2 (i.e., a latch time) after the time point at which the shutdown is performed SD.

As shown in FIGS. 4 and 6, the shutdown circuit 139 turns off the first switching element S1 and turns on the second switching element S2 after the time point at which the shutdown is performed SD so that the working coil WC, the second capacitor C2, and the second switching element S2 form the section through which the current flows.

After the section in which the current flows is formed, the working coil WC exchanges the energy with the capacitor C2, and the resonant current resonates freely and flows through the section in which the current flows.

When the object is not present on the working coil WC, amplitude of the resonant current may be reduced by resistance of the working coil WC.

When the object is present on the working coil WC, the amplitude of the resonant current may be reduced by the resistance of the working coil WC and the resistance of the object (that is, a significant magnitude of the amplitude of the resonance current is reduced compared to a case in which the object is not present on the working coil WC).

Then, the sensor 120 measures the value Ir of the current that resonates freely in the section in which the current flows, and provides the resonance current converter 131 with the information on the measured current value Ir. The resonance current converter 131 converts the current value Ir (i.e., the current value measured after the resonance current freely resonates) into a voltage value Vr (i.e., a second voltage value), and provides the count comparator 137 and the controller 140 with the information on the converted voltage value Vr, respectively.

For example, as the working coil WC has the constant resistance value, the voltage of the working coil WC has a waveform substantially equal to the current of the working coil WC.

Subsequently, the count comparator 137 compares the voltage value Vr with a predetermined reference value of count Vcnt_ref, and generates the output pulse OP based on the result of comparison. The count comparator 137 also provides the controller 140 with the output pulse OP.

The output pulse OP has an on-state when the voltage value Vr is greater than the predetermined reference value of count Vcnt_ref and an off-state when the voltage value Vr is less than the predetermined reference value of count Vcnt_ref.

The controller 140 determines whether the object is present on the working coil WC based on the output pulse OP received from the count comparator 137.

For example, when the count of the output pulse OP is less than a predetermined reference count, the controller 140 may determine that the object is present on the working coil WC. When the count of the output pulse OP is greater than a predetermined reference count, the controller 140 may determine that the object is not present on the working coil WC. The count may refer to a number of instances at which the state of the output pulse OP is changed from the off-state to the on-state.

When the on-duty time of the output pulse OP is less than a predetermined reference time, the controller 140 may determine that the object is present on the working coil WC. When the on-duty time of the output pulse OP is greater than the predetermined reference time, the controller 140 may determine that the object is not present on the working coil WC. The on-duty time may refer to an accumulated time when the output pulse OP is in the on-state in the period of time after the time point at which the shutdown is performed SD (i.e., D3 in FIG. 4).

In some examples, the controller 140 may determine whether the output pulse OP corresponds to an on-state or an off-state based on an amplitude of the output pulse OP. The output pulse OP may include a plurality of on-state pulses and a plurality of off-state pulses in the period of time D3. The controller 140 may accumulate durations of the plurality of on-state pulses of the output pulse OP and may determine the on-duty time of the output pulse OP based on the accumulated durations of the plurality of on-state pulses of the output pulse OP.

That is, the controller 140 may accurately determine whether the object is present on the working coil based on the count or the on-duty time of the output pulse OP.

Then, the controller 140 activates the working coil WC based on the determination whether the object is present on the working coil WC. Further, the controller 140 may display the information on the detection of the object through the display or the interface or generate the notification sound to notify the user of the detection of the object.

Figure 7A:
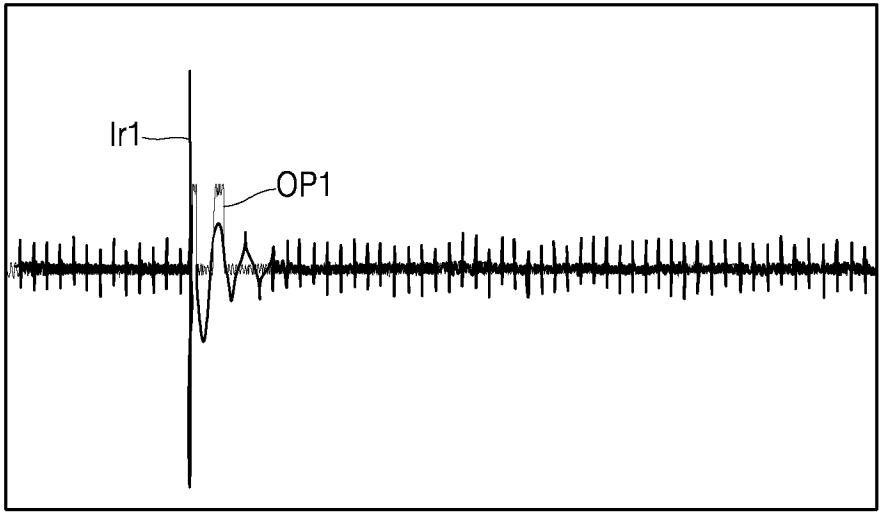
FIG. 7A and FIG. 7B are graphs of example waveforms used in determining whether an object is present, in the induction heating device of FIG. 2.
Figure 7B:
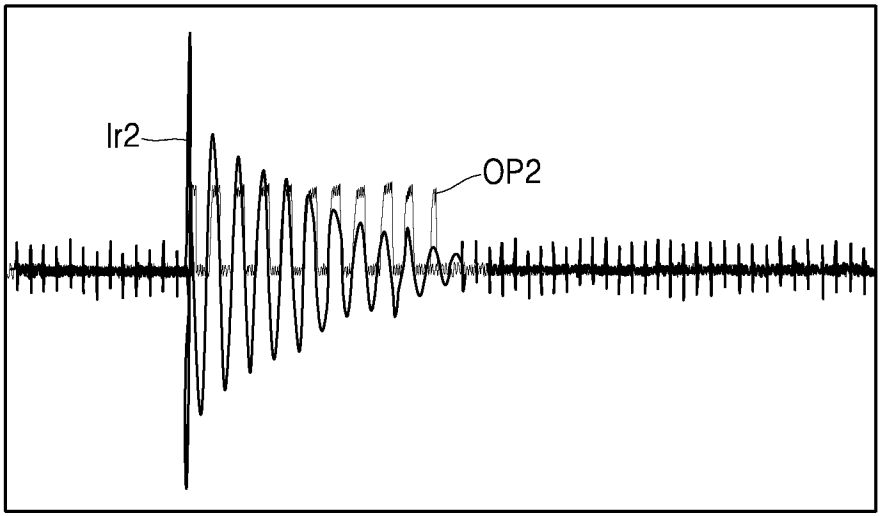

FIG. 7A and FIG. 7B are graphs of example waveforms used in determining whether an object is preset, in the induction heating device of FIG. 2.

For example, FIG. 7A is a waveform generated when the object is arranged on a working coil WC. FIG. 7B is a waveform generated when the object is not arranged on the working coil WC. For example, FIGS. 7A and 7B are only one experimental example, and the implementation of the present disclosure is not limited to the experimental example of FIG. 7A and FIG. 7B.

FIG. 7A shows a first resonance current Ir1 flowing through the working coil WC (see FIG. 2) and a first output pulse OP1 for first resonance current Ir1. Further, FIG. 7B shows a second resonance current Ir2 flowing through the working coil WC (see FIG. 2) and a second output pulse OP2 for the second resonance current Ir2.

For example, the first and second output pulses OP1 and OP2 shown in FIG. 7A and FIG. 7B are used only for the description of the figures.

Referring to FIGS. 2 and 7A and 7B, FIG. 7A shows that a count of the first output pulse OP1 is twice, and FIG. 7B shows a count of the second output pulse OP2 is 11 times. That is, the count is relatively less when the object is arranged on the working coil WC, while the count is relatively greater when the object is not arranged on the working coil WC.

Therefore, a reference count for determining whether the object is present on the working coil WC may be determined as a value between the count of FIG. 7A and the count of FIG. 7B. Further, the controller 140 may determine whether the object is present on the working coil WC based on a predetermined reference count.

Further, the on-duty time of the first output pulse OP1 as shown in FIG. 7A may be shorter than the on-duty time of the second output pulse OP2 as shown in FIG. 7B. That is, when the object is arranged on the working coil WC, the on-duty time is relatively short while the on-duty time is relatively long when the object is not arranged on the working coil WC.

Therefore, a reference time for determining whether the object is present on the working coil WC may be determined as a value corresponding to a time between the on-duty time of FIG. 7A and the on-duty time of FIG. 7B. Further, the controller 140 may determine whether the object is present on the working coil WC based on a predetermined reference time.

That is, the controller 140 may improve accuracy in the determination as to whether the object is present on the working coil WC based on at least one of the count and the on-duty time of an output pulse OP.

Figure 8:
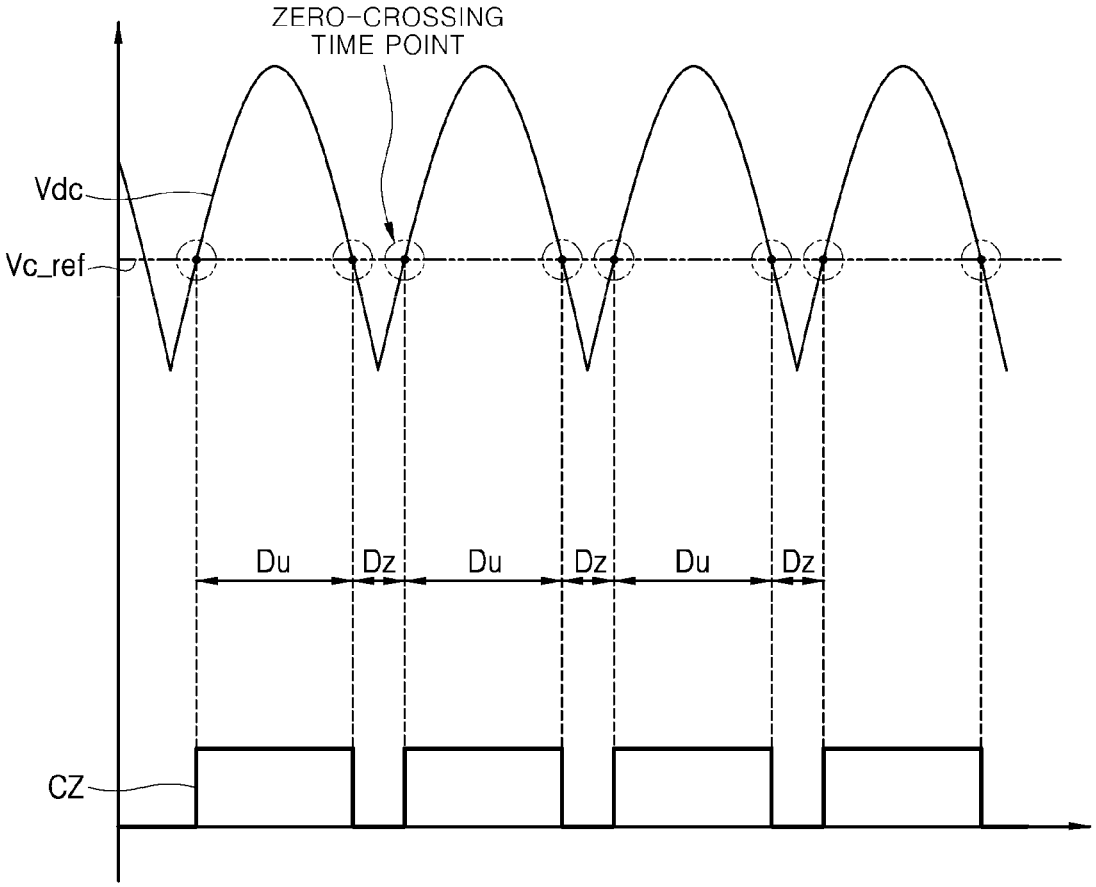
FIG. 8 is a graph of an example of zero crossing time points of input voltage applied to the induction heater of FIG. 2.

FIG. 8 is a graph of an example of zero crossing time points of input voltage applied to the induction heater of FIG. 2.

FIG. 8 shows rectified input voltage Vdc and a zero voltage detection waveform CZ for the input voltage Vdc.

Referring to FIGS. 2 and 8, the input voltage Vdc has a half wave rectified waveform through a rectifying operation of a rectifier 112. For example, the input voltage Vdc may have a half wave rectified waveform that fluctuates around about 150V.

A time point at which the input voltage Vdc becomes equal to a predetermined reference voltage Vc_ref is referred to as "a zero-crossing time point" (i.e., zero voltage time point).

The input voltage Vdc is classified into a first section Dz in which the input voltage Vdc is less than a predetermined reference voltage Vc_ref and a second section Du in which the input voltage Vdc is greater than a predetermined reference voltage Vc_ref based on the zero-crossing time point.

A fluctuation amount of the input voltage Vdc in the first section Dz is relatively less than the fluctuation amount of the input voltage Vdc in the second section Du, such that the controller 140 may perform the detection of the vessel relatively stable in the first section Dz.

Accordingly, the controller 140 may perform the operation of detecting the vessel only in the first section Dz in which the input voltage Vdc is less than the predetermined reference voltage Vc_ref.

The controller 140 may detect the zero crossing time point of the input voltage Vdc and may determine whether the object is present on the working coil WC in the section in which the input voltage Vdc is less than the reference voltage Vc_ref based on the zero-crossing time point.

For example, the controller 140 may only perform some steps (for example, S200 of FIG. 12) of operation of pre-testing of a single pulse described below in a first section Dz, and details thereof will be described below.

In some implementations, the induction heating device 100 may perform the operation of detecting the vessel only in the first section Dz, thereby improving the accuracy and the reliability in the detection of the vessel by the induction heating device 100.

FIGS. 9 to 11B show example operations of detecting a vessel changed depending on fluctuation of input voltage applied to the induction heater of FIG. 2.

Figure 9:
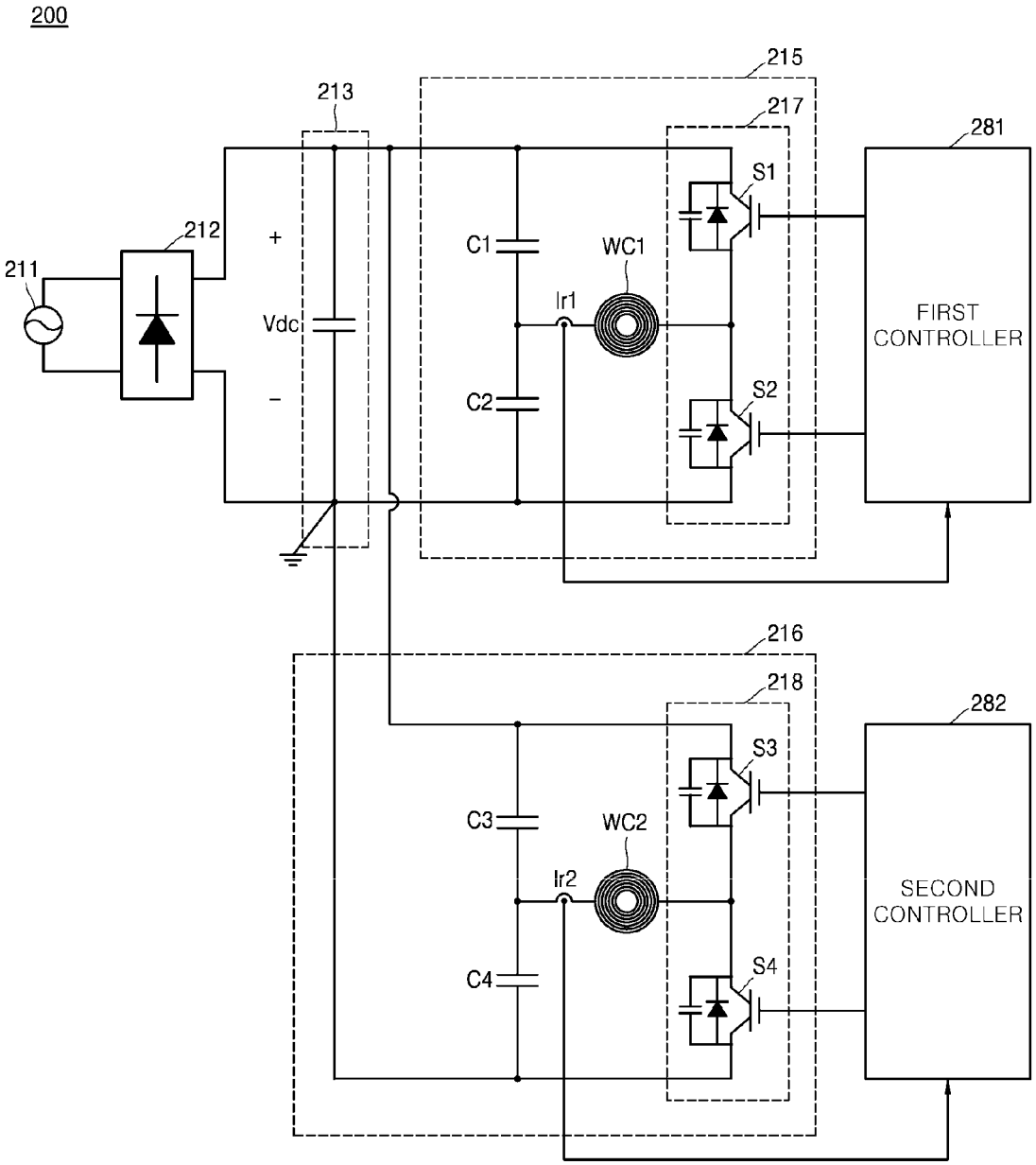
FIGS. 9 to 11B show an example operation of detecting a vessel that is changed depending on fluctuation of input voltage applied to the induction heater of FIG. 2.

For example, FIG. 9 is a schematic view of an induction heating device 200 according to other implementations of the present disclosure.

Referring to FIG. 9, the induction heating device 200 includes a first induction heater 215 and a second induction heater 216. The first induction heater 215 shares the same input voltage Vdc with the second induction heater 216. For example, the first induction heater 215 and the second induction heater 216 may be arranged adjacent to each other.

The first induction heater 215 is controlled by the first controller 281 and the second induction heater 216 is controlled by the second controller 282.

The first induction heater 215 and the second induction heater 216 are substantially the same as the above-described induction heater (115 in FIG. 2). In addition, the first controller 281 and the second controller 282 are substantially the same as the controller (180 of FIG. 2) described above. The description of the induction heater 115 and the controller 180 has been described in detail above, and is omitted.

When the second induction heater 216 is operated, organic current may be generated in the first induction heater 215.

Figure 10:
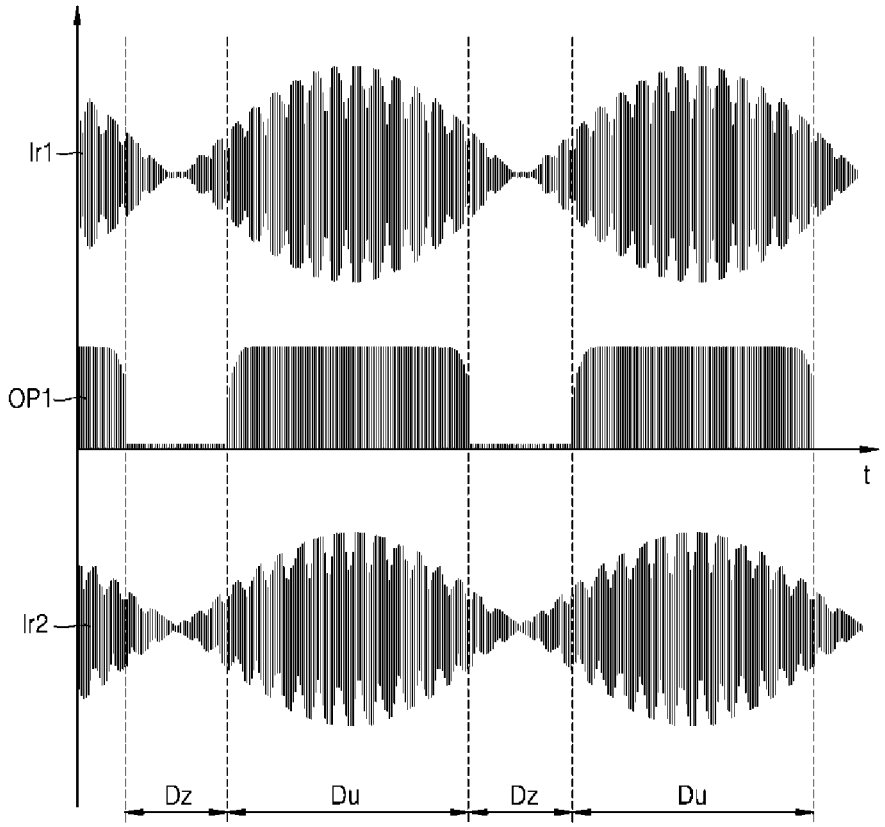

FIG. 10 shows current flowing through a second working coil WCS when the second induction heater 216 is operated. The first current Ir1 is induced into the first working coil WC1 as the second induction heater 216 is operated. A comparator output OP1 represents an output pulse output from a count comparator by first current Ir1.

Referring to the graph of FIG. 10, the first current Ir1 is divided into a first section Dz, in which a magnitude of current is less than a preset current magnitude, and a second section Du, in which a magnitude of current is greater than a preset current magnitude. At this time, a boundary point between the first section Dz and the second section Du corresponds to a zero-crossing time point.

In the first section Dz, it can be understood that the magnitude of the first current Ir1 induced by the operation of the second induction heater 216 is less and the comparator output OP1 is not output.

In some implementations, the first controller 281 may perform the operation of detecting the vessel in the first section Dz. That is, the controller the first controller 281 includes may perform the operation of detecting the vessel in the section where the current induced to the first working coil WC1 is less than the predetermined reference current (that is, a first section (Dz)).

As a result, according to the present disclosure, the method of detecting the vessel may be less influenced by the operation of other working coils. Therefore, the present disclosure may improve the accuracy and the reliability in the detection of the vessel.

Figure 11A:
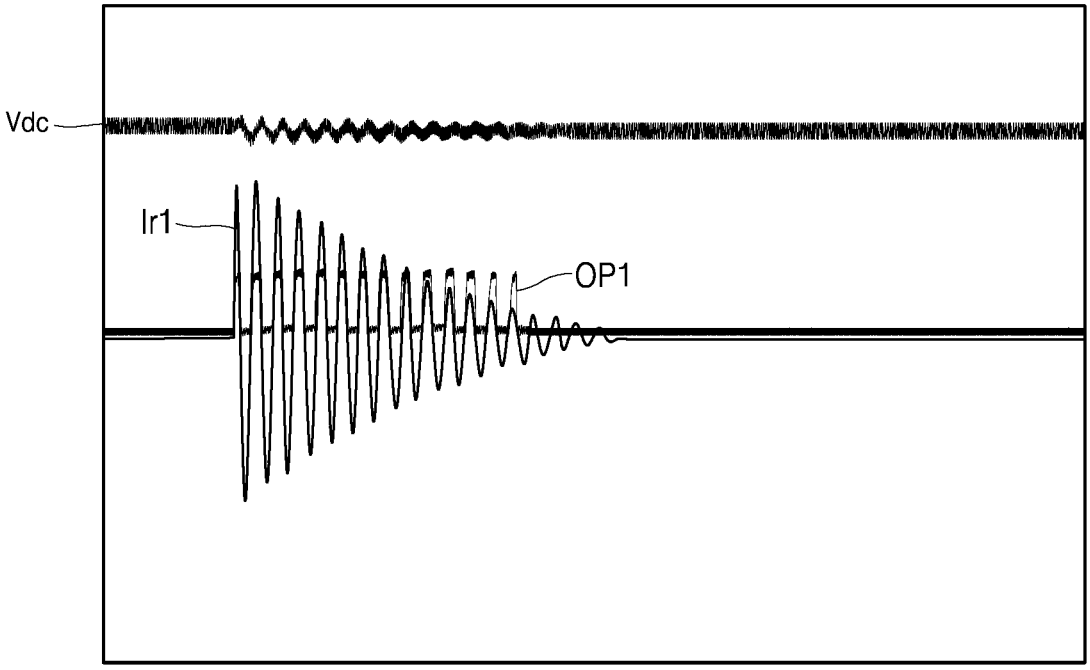
Figure 11B:
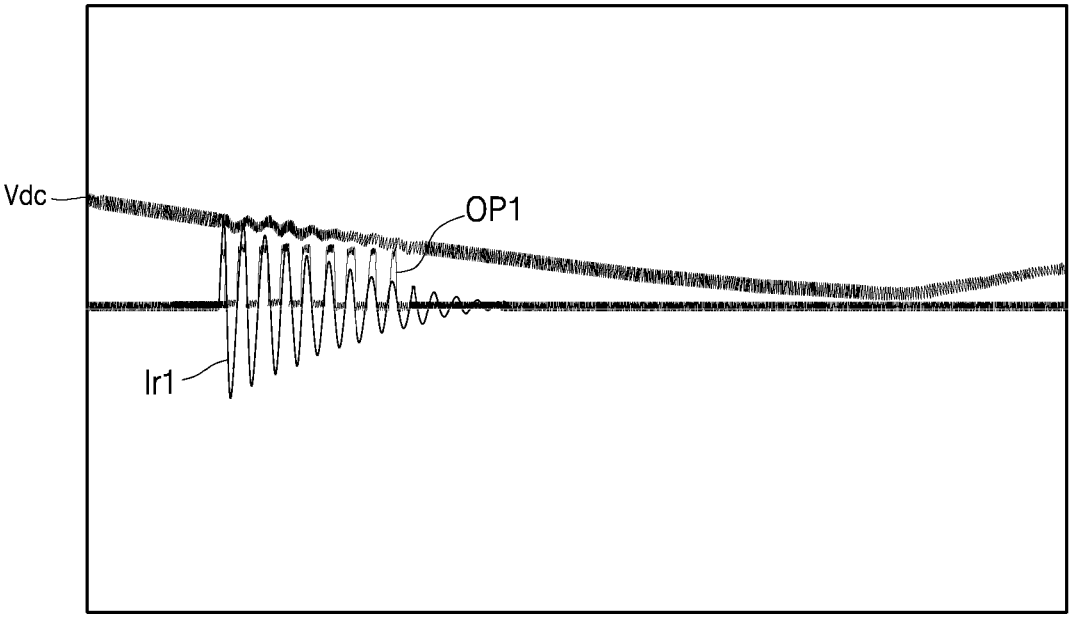

FIG. 11A is a graph of a waveform of a first induction heater 215 when the second induction heater 216 is not operated. FIG. 11B is a graph of a waveform of the first induction heater 215 when the second induction heater 216 is operated.

In the case of FIG. 11A, input voltage Vdc having a constant magnitude is applied to the first induction heater 215.

In the case of FIG. 11B, unstable input voltage Vdc is applied to the first induction heater 215 and is generated when the first induction heater 215 and the second induction heater 216 share the input voltage Vdc. The input voltage Vdc applied to the first induction heater 215 becomes low because the second induction heater 216 uses a portion of the power provided by the input voltage Vdc.

Therefore, when a constant-sized input voltage Vdc is applied as shown in FIG. 11A, the controller applies a single pulse having a relatively short first length (for example, 1-pulse in FIG. 4) to a shutdown circuit because the pulse having the first length is sufficient to charge the working coil WC.

To the contrary, as shown in FIG. 11B, when the input voltage Vdc which is unstable and has the relatively small magnitude is applied, the controller transmits a pulse having a second length longer than the first length to the shutdown circuit to stably charge the working coil WC by applying a pulse having the second length longer than the first length.

In addition, the controller may compare the amount of fluctuation in the input voltage Vdc with a predetermined reference value of fluctuation, and may determine the length of a single pulse provided to the shutdown circuit based on the result of comparison.

Specifically, when the amount of the fluctuation in the input voltage Vdc is greater than the predetermined reference value of fluctuation, the controller may output a single pulse having the second length. The reference value of fluctuation means a value for determining whether another induction heater is operated.

For example, when the first and second induction heaters 215 and 216 share the input voltage Vdc and the second induction heater 216 is operated, the fluctuation amount of the input voltage Vdc applied to the first induction heater 215 may be increased (see FIG. 11B). In this case, the controller outputs a pulse having a relatively long second length.

When the fluctuation amount of the input voltage Vdc is less than the predetermined reference value of fluctuation, the controller outputs a single pulse having a first length shorter than the second length.

In other words, the vessel detector may generate resonance current of a certain magnitude in the working coil WC through the above-described method, thereby improving the accuracy in the determination of the vessel detection.

For example, according to some implementations of the present disclosure, the induction heating device may perform an operation of pre-testing of a single pulse before an actual operation of detecting the vessel described above is performed. Hereinafter, a method for pre-testing of a single pulse performed by a controller provided in an induction heating device will be described with reference to FIGS. 12 and 13.

Figure 12:
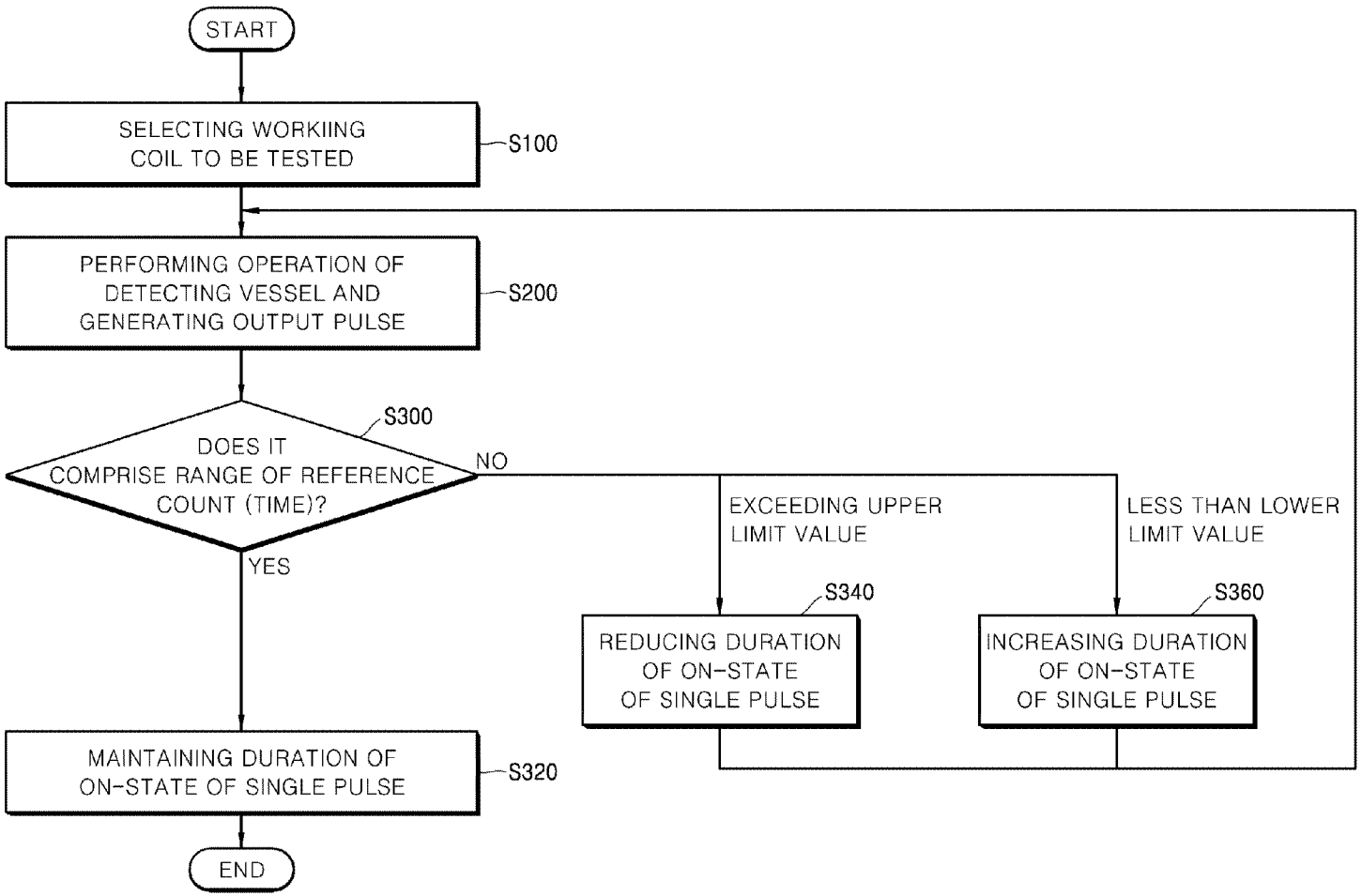
FIGS. 12 and 13 are flow chart of an example method for pre-testing of a single pulse of an example induction heating device.
Figure 13:
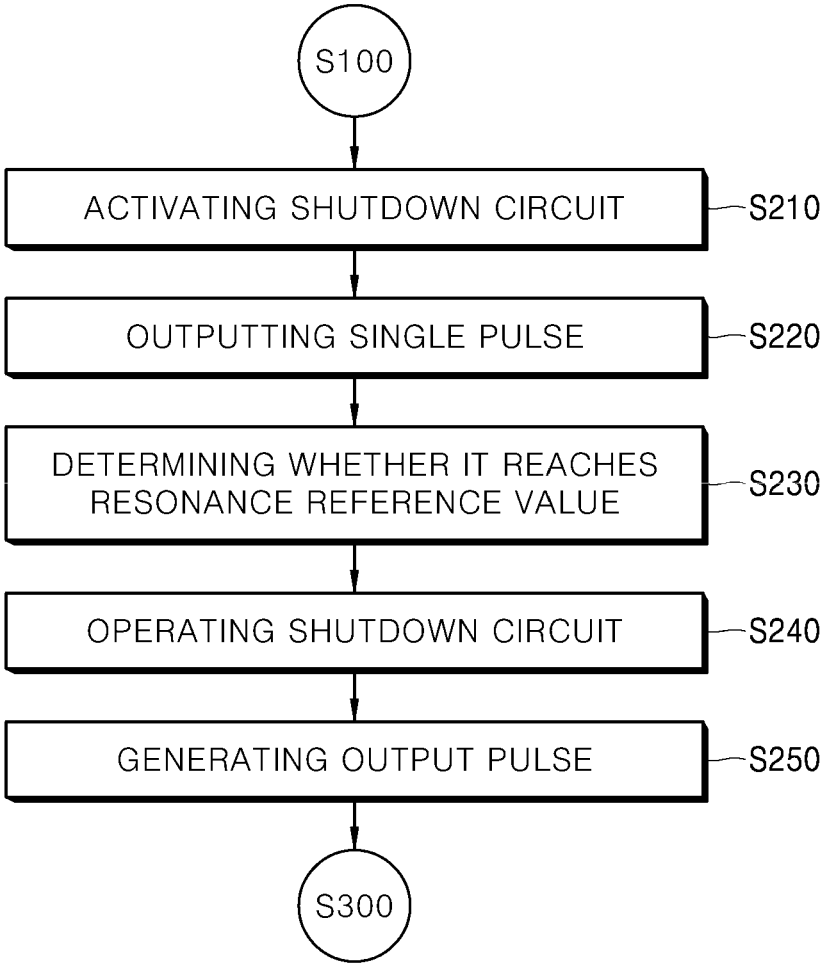

FIGS. 12 and 13 are flow charts of example methods for pre-testing of a single pulse of an induction heating device according to some implementations of the present disclosure.

For example, for convenience of explanation, the induction heating device as shown in FIG. 2 will be mainly described hereinafter and it is considered that the sensor 120 (as shown in FIG. 2) includes the controller 180 (as shown in FIG. 2).

Referring to FIGS. 2 and 12, a working coil to be tested is selected first (S100).

Specifically, the controller 140 may select a working coil to be tested. The working coil to be tested may be a working coil that does not have an object on upper side of the working coil (that is, a working coil in a no-load state).

In some cases, as shown in FIG. 2, when only one working coil WC is provided in the induction heating device 100, the controller 140 may select the working coil WC as a working coil to be tested.

As shown in FIG. 9, when a plurality of working coils (WC1 and WC2 in FIG. 9) are provided in the induction heating device (200 in FIG. 9), the controller 140 may select any one of a plurality of working coils as a working coil to be tested.

When the working coil to be tested is selected (S100), an output pulse (i.e., a first output pulse) is generated (S200) by performing an operation of detecting the vessel or a detection operation. For example, the output pulse may be generated based on performance of some steps of the operation of detecting the vessel.

FIG. 13 shows an example of detailed steps of S200.

Specifically, referring to FIGS. 2 and 13, when the working coil to be tested is selected (S100), the shutdown circuit 139 is activated (S210). Then, when the shutdown circuit 139 is activated, the controller 140 outputs a single pulse (PWM1 in FIG. 4; that is, 1-pulse) to charge the working coil to be tested with the energy (S220). At this time, the shutdown circuit 139 may control the switch driver 150 based on the single pulse received from the controller 140 and the above-mentioned output signal OS.

For example, the controller 140 may output a single pulse having a duration of the on-state, which is initially set, in S220. The duration of the on-state, which is initially set, may refer to the duration of the on-state required to charge the working coil in the no-load state with a certain amount of energy (that is, an amount of energy that is a standard of the above-mentioned shutdown operation).

When a single pulse is output from the controller 140 (S220), the switch driver 150 controls the inverter 117 so that the working coil to be tested is charged with the energy of the input voltage Vdc.

At this time, the first switching element S1 included in the inverter 117 may be turned on and the second switching element S2 may be turned off.

In some examples, the sensor 120 may measure the value Ir of the current flowing through the working coil to be tested. The resonance current converter 131 converts the current value Ir measured by the sensor 120 into a voltage value Vr (that is, a first voltage value).

Then, the shutdown comparator 135 determines whether the voltage value Vr received from the resonance current converter 131 reaches a predetermined reference value of resonance (Vr_ref in FIG. 4) (S230).

When the received voltage value Vr reaches a predetermined reference value of resonance (Vr_ref in FIG. 4), the output signal OS of the shutdown comparator 135 is activated.

When the output signal OS is activated, the shutdown circuit 139 operates based on the output signal OS (S240).

Specifically, the shutdown circuit 139 controls the switch driver 150 such that the current flowing through the working coil to be tested resonates freely. That is, the shutdown circuit 139 may form a section where current flows through the induction heater 115 by controlling the inverter 117 through the switch driver 150.

At this time, the first switching element S1 the inverter 117 includes may be turned off, and the second switching element S2 may be turned on. Further, the output signal OS of the shutdown comparator 135 may be maintained in an activated state by the latch circuit 133 for a predetermined period of time.

Then, the sensor 120 measures the value Ir of the current that resonates freely in the section through which the current flows, and transmits the information on the value Ir of the current to the resonance current converter 131. The resonance current converter 131 converts the current value Ir to a voltage value Vr (that is, a second voltage value) and transmits the information on the converted voltage value Vr to the count comparator 137 and the controller 140.

The count comparator 137 generates an output pulse OP (that is, a first output pulse) (S250).

Specifically, the count comparator 137 generates the output pulse OP based on the result of comparison between the voltage value Vr and the predetermined reference value of count (Vcnt_ref in FIG. 4), and outputs the generated output pulse OP to the controller 140.

The output pulse OP has an on-state when the voltage value Vr is greater than a predetermined reference value of count (Vcnt_ref in FIG. 4), and the voltage value Vr has an off-state when the voltage value V4 is less than the predetermined reference value of count (Vcnt_ref of FIG. 4).

For example, in performing the operation of detecting the vessel to generate the output pulse (S200), the operation of detecting the vessel is performed N times (N is a natural number), and M-number of output pulses (M is equal to the N) may be generated. That is, when the operation of detecting the vessel is performed a plurality of times, a plurality of output pulses may be generated correspondingly.

In addition, S200 may be performed in the first section (Dz in FIG. 8), but is not limited thereto.

Referring back to FIGS. 2 and 12, the count of the output pulse generated after S200 is compared with a predetermined reference count range, or the on-duty time of the output pulse is compared with a predetermined reference time range (S300).

Specifically, the controller 140 compares the count of the output pulse OP received from the count comparator 137 with a predetermined reference count range, or compares the on-duty time of the output pulse OP with a predetermined reference time range.

Then, when the comparison operation is completed (S300), a duration of the on-state of the single pulse generated by the controller 140 is adjusted based on the result of comparison (S320, S340, S360).

Specifically, when the count of the output pulse OP is greater than the upper limit value of the predetermined reference count range or the on-duty time of the output pulse OP is greater than the upper limit value of the predetermined reference time range, the controller 140 reduces the duration of the on-state of the single pulse (S340).

That is, when the count of the output pulse OP is greater than the upper limit value of the predetermined reference count range or the on-duty time of the output pulse OP is greater than the upper limit value of the predetermined reference time range, the amount of the energy with which the working coil to be tested is charged is greater than the amount of the energy which is a standard of above-mentioned shutdown operation. Accordingly, it is possible to reduce the amount of the energy with which the working coil to be tested is charged by reducing the duration of the on-state of the single pulse.

When the count of the output pulse OP is less than the lower limit value of the predetermined reference count range or the on-duty time of the output pulse OP is less than the lower limit value of the predetermined reference time range, the controller 140 increases the duration of the on-state of the single pulse (S360).

That is, when the count of the output pulse OP is less than the lower limit value of the predetermined reference count range or the on-duty time of the output pulse OP is less than the lower limit value of the predetermined reference time range, the amount of the energy with which the working coil to be tested is charged is less than the amount of the energy which is a standard of above-mentioned shutdown operation. Accordingly, it is possible to increase the amount of the energy with which the working coil to be tested is charged by increasing the duration of the on-state of the single pulse.

In some examples, when the count of the output pulse OP is included within the predetermined reference count range or the on-duty time of the output pulse OP is included within the predetermined reference time range, the controller 140 maintains the duration of the on-state of the single pulse (S320).

That is, when the count of the output pulse OP is included within the predetermined reference count range or the on-duty time of the output pulse OP is included within the predetermined reference time range, the amount of the energy with which the working coil to be tested is charged meets the amount of the energy which is a standard of the above-mentioned shutdown operation. Accordingly, it is possible to maintain the amount of the energy with which the working coil to be tested is charged by maintaining the duration of the on-duty of the single pulse.

In summary, the amount of energy with which the working coil to be tested is charged during the operation of detecting the vessel is changed depending on the duration of the on-state of the single pulse. Accordingly, when the duration of the on-state of the single pulse is increased, the amount of the energy with which the working coil to be tested is charged in the operation of detecting the vessel is increased. When the duration of the on-state of the single pulse is decreased, the amount of the energy with which the working coil to be tested is charged in the operation of detecting the vessel is reduced.

For example, when N-number of operation of detecting the vessel (N is natural number) is performed and M-number of output pulses are generated (M is equal to the N), the count of the output pulses OP may include the average value of the count of the M-number of output pulse and the on-duty time of the output pulse OP may include the average value of the on-duty time of the M-number of the output pulses.

As described above, the operation of pre-testing of a single pulse may be performed prior to an actual operation of detecting the vessel.

However, if the duration of the on-state of the single pulse is changed (S340 or S360), the above-described processes may be repeated again.

That is, performing the operation of detecting the vessel on the working coil to be tested based on the single pulse having the changed duration of the on-state to generate the output pulse (that is, the second output pulse) (that is, the step corresponding to S200), comparing, by the controller 140, the count of the output pulse with the predetermined reference count range or comparing the on-duty time of the output pulse with the predetermined reference time range (that is, the step corresponding to S300), and adjusting the changed duration of the on-state of the single pulse based on the result of comparison (that is, the step corresponding to any one of S320, S340, and S360) may proceed.

In some cases, when the duration of the on-state of the single pulse is maintained (S320), the duration of the on-state of the single pulse may be determined as a final duration of the on-state of the single pulse for the actual operation of detecting the vessel.

For example, according to some implementations of the present disclosure, as shown in FIG. 11A and FIG. 11B, the induction heating device may change the duration (that is, length) of the on-state of the single pulse even during an actual operation of detecting the vessel.

As described above, according to some implementations of the present disclosure, power consumption of the induction heating device may be reduced and response characteristics of the induction heating device may be improved through the method for pre-testing of a single pulse of the induction heating device, thereby preventing waste of power and improving user satisfaction.

Further, according to some implementations of the present disclosure, the accuracy of the operation of detecting the vessel may be improved through the method for pre-testing the single pulse of the induction heating device, thereby enhancing the reliability of the operation of detecting the vessel.

It is to be understood that the above-described implementations are to be considered in all respects as illustrative and not restrictive, and the scope of the present disclosure will be indicated by the appended claims described below rather than by the above-mentioned detailed description. It is to be construed that meaning and scope of claims described below, as well as all changes and modification obtained from equivalents thereof are included in the scope of the present disclosure.

What is claimed is:

1. A method for controlling an induction heating device having one or more working coils and a controller configured to perform pre-testing based on a single pulse having a preset duration of an on-state, the method comprising:

selecting a working coil to be tested among the one or more working coils;

performing a detection operation to detect a vessel disposed on the working coil and to generate, based on applying the single pulse to a circuit connected to the working coil, a first output pulse having an on-state and an off-state;

comparing at least one of:

a count of the first output pulse to a predetermined reference count range, or an on-duty time of the first output pulse to a predetermined reference time range;

adjusting, by the controller, the preset duration of the on-state of the single pulse based on (i) a result of the comparison of the count of the first output pulse to the predetermined reference count range or (ii) a result of the comparison of the on-duty time of the first output pulse to the predetermined reference time range;

based on the count of the first output pulse being less than a predetermined reference count value, determining that the vessel is present on the working coil; and based on the count of the first output pulse being greater than the predetermined reference count value, determining that the vessel is not present on the working coil.

2. The method of claim 1, wherein the count of the first output pulse comprises a number of instances at which the first output pulse is changed from the off-state to the on-state, and wherein adjusting the preset duration of the on-state of the single pulse comprises:

based on the count of the first output pulse being greater than an upper limit value of the predetermined reference count range, decreasing the preset duration of the on-state of the single pulse;

based on the count of the first output pulse being less than a lower limit value of the predetermined reference count range, increasing the preset duration of the on-state of the single pulse; and based on the count of the first output pulse being within the predetermined reference count range, maintaining the preset duration of the on-state of the single pulse.

3. The method of claim 1, wherein the on-duty time of the first output pulse comprises an accumulated time of on-state durations of the first output pulse, and wherein adjusting the preset duration of the on-state of the single pulse comprises:

based on the on-duty time being greater than an upper limit value of the predetermined reference time range, decreasing the preset duration of the on-state of the single pulse;

based on the on-duty time being less than a lower limit value of the predetermined reference time range, increasing the preset duration of the on-state of the single pulse; and based on the on-duty time being within the predetermined reference time range, maintaining the preset duration of the on-state of the single pulse.

4. The method of claim 1, further comprising:

based on the preset duration of the on-state of the single pulse being changed, performing the detection operation to generate a second output pulse having an on-state and an off-state;

comparing at least one of (i) a count of the second output pulse to the predetermined reference count range or (ii) an on-duty time of the second output pulse to the predetermined reference time range; and adjusting the changed duration of the on-state of the single pulse based on (i) a result of the comparison of the count of the second output pulse to the predetermined reference count range or (ii) a result of the comparison of the on-duty time of the second output pulse to the predetermined reference time range.

5. The method of claim 1, wherein performing the detection operation comprises:

repeating the detection operation for a plurality of times to generate the first output pulse.

6. The method of claim 5, wherein the count comprises an average value of counts of a plurality of the first output pulses generated by repeating the detection operation for the plurality of times, and wherein the on-duty time comprises an average value of on-duty durations of the plurality of the first output pulses.

7. The method of claim 1, further comprising:

charging the working coil with energy based on the single pulse, wherein an amount of energy charged in the working coil during the detection operation varies based on the preset duration of the on-state of the single pulse.

8. The method of claim 7, wherein the amount of energy charged in the working coil during the detection operation increases based on an increase of the preset duration of the on-state of the single pulse, and wherein the amount of energy charged in the working coil during the detection operation decreases based on a decrease of the preset duration of the on-state of the single pulse.

9. The method of claim 1, wherein performing the detection operation comprises:

controlling an inverter of the induction heating device to charge the working coil with energy;

measuring, by a sensor of the induction heating device, a current in the working coil;

converting a first current value of the current measured by the sensor into a first voltage value;

comparing, by a shutdown comparator of the induction heating device, the first voltage value to a predetermined reference resonance value;

controlling a switch driver of the induction heating device to cause resonance of the current in the working coil based on the first voltage value being greater than the predetermined reference resonance value;

measuring, by the sensor, a resonant current in the working coil based on the resonance of the current in the working coil;

converting a second current value of the resonant current in the working coil into a second voltage value; and comparing the second voltage value to the predetermined reference count value to generate the first output pulse.

10. The method of claim 9, wherein the inverter comprises a first switching element and a second switching element that are configured to be turned on and turned off based on a switching signal received from the switch driver, and wherein controlling the inverter comprises controlling one or both of the first switching element and the second switching element.

11. The method of claim 10, wherein charging the working coil with energy comprises:

turning on the first switching element and turning off the second switching element.

12. The method of claim 10, wherein controlling the switch driver to cause the resonance of the current in the working coil comprises:

turning off the first switching element and turning on the second switching element.

13. The method of claim 9, wherein controlling the switch driver to cause the resonance of the current in the working coil comprises:

maintaining an output signal of the shutdown comparator in an activated state for a predetermined period of time.

14. The method of claim 9, wherein comparing the second voltage value to the predetermined reference count value to generate the first output pulse comprises:

generating the first output pulse in an on-state based on the second voltage value being greater than the predetermined reference count value; and generating the first output pulse in an off-state based on the second voltage value being less than the predetermined reference count value.

15. The method of claim 1, wherein selecting the working coil comprises selecting one working coil that does not seat an object among the one or more working coils.

16. The method of claim 1, further comprising:

counting a number of instances at which the first output pulse is changed from an off-state to an on-state; and based on counting the number of instances at which the first output pulse is changed from the off-state to the on-state, determining the count of the first output pulse.

17. The method of claim 1, further comprising:

based on an amplitude of the first output pulse, determining whether the first output pulse corresponds to an on-state or an off-state, wherein the first output pulse comprises a plurality of on-state pulses and a plurality of off-state pulses;

accumulating durations of the plurality of on-state pulses of the first output pulse; and determining the on-duty time of the first output pulse based on the accumulated durations of the plurality of on-state pulses of the first output pulse.

18. The method of claim 1, wherein the method comprises comparing the count of the first output pulse to the predetermined reference count range, and wherein adjusting the preset duration of the on-state of the single pulse is based on the result of the comparison of the count of the first output pulse to the predetermined reference count range.

19. The method of claim 1, wherein the method comprises comparing the on-duty time of the first output pulse to the predetermined reference time range, and wherein adjusting the preset duration of the on-state of the single pulse is based on the result of the comparison of the on-duty time of the first output pulse to the predetermined reference time range.

20. The method of claim 5, wherein repeating the detection operation for the plurality of times comprises:

generating one first output pulse in each of the plurality of times of the detection operation.

* * * * *